US008957339B2

(12) United States Patent
Sekiguchi et al.

(10) Patent No.: US 8,957,339 B2
(45) Date of Patent: Feb. 17, 2015

(54) DOME-SHAPED SPRING AND SWITCH USING THE SAME

(75) Inventors: Chikara Sekiguchi, Yamato (JP); Shigenori Inamoto, Sagamihara (JP); Masahiko Aranai, Tendo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 353 days.

(21) Appl. No.: 13/467,294

(22) Filed: May 9, 2012

(65) Prior Publication Data

US 2012/0285812 A1 Nov. 15, 2012

(30) Foreign Application Priority Data

May 13, 2011 (JP) ..... 2011-107861

(51) Int. Cl.
*H01H 13/70* (2006.01)
*H01H 1/06* (2006.01)

(52) U.S. Cl.
CPC ..... *H01H 1/06* (2013.01); *H01H 2201/022* (2013.01); *H01H 2215/004* (2013.01); *H01H 2215/012* (2013.01); *H01H 2227/022* (2013.01)
USPC ..... 200/513

(58) Field of Classification Search
CPC ..... H01H 13/48; H01H 13/52; H01H 13/70; H01H 13/85
USPC ..... 200/406, 512–520
See application file for complete search history.

(56) References Cited

U.S. PATENT DOCUMENTS

| | | | | |
|---|---|---|---|---|
| 4,933,522 | A * | 6/1990 | Celander | 200/513 |
| 6,683,265 | B2 * | 1/2004 | Masuda | 200/406 |
| 8,389,885 | B2 * | 3/2013 | Inamoto et al. | 200/513 |
| 2001/0035334 | A1 * | 11/2001 | Andersson et al. | 200/5 A |

FOREIGN PATENT DOCUMENTS

| | | | |
|---|---|---|---|
| EP | 2290669 | A1 * | 3/2011 |
| JP | 2011-034927 | A | 2/2011 |

* cited by examiner

*Primary Examiner* — Amy Cohen Johnson
*Assistant Examiner* — Marina Fishman
(74) *Attorney, Agent, or Firm* — Holtz, Holtz, Goodman & Chick PC

(57) ABSTRACT

Provided is a dome-shaped spring for placing on a substrate having stationary contacts, and a circumferential edge of the dome-shaped spring is continuously in contact with the stationary contacts. At least a part of a neutral plane has a shape defined by an even function of at least eighth-order. Angle α of the neutral plane of the dome-shaped spring to the substrate at a second inflection point that exists at a second-positioned inflection point from the circumferential edge, angle β of the neutral plane to the substrate at a first inflection point, and angle γ of the neutral plane at the circumferential edge of the dome-shaped spring to the substrate satisfy following inequalities of α β and β γ.

10 Claims, 16 Drawing Sheets

DOME-SHAPED SPRING AND SWITCH USING THE SAME

CROSS-REFERENCE TO RELATED APPLICATION

The present U.S. application claims a priority under the Paris Convention of Japanese Patent Application No. 2011-107861 filed on May 13, 2011, which shall be a basis of correction of an incorrect translation.

BACKGROUND

1. Field of the Invention

The present invention relates to a dome-shaped spring and a switch using the dome-shaped spring.

2. Description of Related Art

It is generally known to use a push button switch with a tactile (click) action for operating an electronic device such as a mobile phone. A push button switch with a click action is a button that can provide a click feel to a user when a user pushes the button. Such a push button switch with a click action is provided with a dome-shaped spring (dome-shaped contact spring).

It is also known an aspheric dome-shaped spring having a smaller size and better click feel than a spherical dome-shaped spring and a switch using the aspheric dome-shaped spring (see JP-2011-34927A). Such a conventional aspheric dome-shaped spring and a switch using the spring will be explained with reference to FIGS. 15 and 16. FIG. 15 is a sectional structure of a conventional switch 100. FIG. 16 shows a contacting between a circumferential edge 21*c* of a conventional dome-shaped spring 21 and a stationary contact 4.

The switch 100 has, as shown in FIG. 15, a dome-shaped spring 21, substrate 3, and stationary contacts 4, 5 and 6. The dome-shaped spring 21 is a dome-shaped spring for a contact of which the whole surface is aspheric and made of conducting metal. The dome-shaped spring 21 has a circular shape in a plan view and the center of the circle is designated as a movable contact 21*a*. FIG. 15 is a cross-sectional view along a plane passing through the movable contact 21*a* of the dome-shaped spring 21.

The substrate 3 is a substrate on which the dome-shaped spring 21 is disposed. The substrate 3 is provided with stationary contacts 4, 5 and 6. The stationary contacts 4, 5 and 6 are electrical contacts made of conducting metal. The stationary contacts 4 and 5 continuously support the dome-shaped spring 21. The stationary contact 6 is located at a position corresponding to the movable contact 21*a* of the dome-shaped spring 21.

The dome-shaped spring 21 becomes deformed by applying an acting load F onto the movable contact 21*a* of the dome-shaped spring 21 from vertically upside by a user. By continuing application of the load F, a click action occurs by buckling of the dome-shaped spring 21, and the movable contact 21*a* becomes in contact with the stationary contact 6. The stationary contacts 4 and 5 are brought into conduction with the stationary contact 6 via the dome-shaped spring 21 in this way. After releasing of application of the load F, by ceasing the pressing by the user, the dome-shaped spring 21 returns to the initial shape. During the repeating movements of the pressing and releasing of the dome-shaped spring 21, the contacting position of the circumferential edge 21*c* of the dome-shaped spring 21 and the stationary contact 4 displaces in a radius vector direction (side to side in FIG. 16) repeatedly. In the repeated movement, an angle between the dome-shaped spring 21 and the substrate 3 at the circumferential edge 21*c* is designated as θ2.

A shape of the dome-shaped spring 21 is expressed by the following equation (1) that defines a shape of a neutral plane in a cross-section of the spring without acting load F. The equation is an aspheric equation of a sixth-order even function;

$$f(\rho)=b_1\cdot\rho^6+b_2\cdot\rho^4+b_3\cdot\rho^2+h \quad (1)$$

where ρ is a radius vector from a plane center (the center point in a plan view) of the dome-shaped spring, $b_1$, $b_2$ and $b_3$ are coefficients, h is a height of the dome-shaped spring from the placing surface (substrate) at the plane center, and f(ρ) is a height of the dome-shaped spring from the placing surface (substrate) at a position of radius vector ρ.

On the placing surface (surface of the substrate 3) of the dome-shaped spring 21, an outer diameter Da is defined as a length between two contacting positions of the circumferential edge 21*c* of the dome-shaped spring 21 and the placing surface, where a line connecting the two positions pass through the plane center of the dome-shaped spring 21. There are inflection points Pa1 in the equation (1) between the position corresponding to the outer diameter Da and the plane center of the dome-shaped spring 21. A diameter Da1 on the placing surface (substrate 3) of the dome-shaped spring 21 is defined as a length of a line connecting two inflection points Pa1 that passes through the plane center of the dome-shaped spring 21.

In connection with the outer diameter Da, an angle γ1 is defined as an angle which a neutral plane of the dome-shaped spring 21 at the circumferential edge of the dome-shaped spring 21 forms with a surface (placing surface of the dome-shaped spring 21) of the substrate 3 (stationary contacts 4, 5). In connection with the diameter Da1, an angle β1 is defined as an angle which a neutral plane of the dome-shaped spring 21 at the inflection point Pa1 forms with a surface of the substrate 3 (placing surface of the dome-shaped spring 21). The dome-shaped spring 21 satisfies the following equation (2).

$$\beta 1 \leq \gamma 1 \quad (2)$$

The equations (1) and (2) mean conditions that a buckling occurs in the dome-shaped spring 21. Because the dome-shaped spring 21 has a shape that satisfies the equations (1) and (2), it can be downsized compared with a spherical dome-shaped spring and click action caused by the buckling occurs without fail. The equation (1) may be an even function of eighth-order or more.

However, as shown in FIG. 16, a contacting force at the stationary contact 4 is large because the circumferential edge 21*c* of the dome-shaped spring 21 is supported by the stationary contact 4. Therefore, the circumferential edge 21*c* and the stationary contact 4 tend to become worn by displacement of the circumferential edge 21*c* side to side caused by the repeated movement of pressing and releasing of the dome-shaped spring 21. In the case where the dome-shaped spring 21 is made of SUS (Steel Use Stainless) and the stationary contact 4 is made of copper foil, the stationary contact 4 becomes worn out because the stationary contact 4 is softer than the dome-shaped spring 21. The same phenomenon occurs at the stationary contact 5. It may cause a conductive failure between the stationary contacts 4, 5 and the stationary contact 6 when the dome-shaped spring 21 is pressed.

SUMMARY

An object of the present invention is to downsize a dome-shaped spring and obtain a tactile (click) action with reliability, and reduce wear of a circumferential edge of a dome-shaped spring and stationary contacts caused by repeated movements of pressing and releasing of the dome-shaped spring.

In accordance with a first aspect of the invention, a dome-shaped spring is provided that is disposed on a substrate having a first stationary contact and a circumferential edge of the dome-shaped spring is continuously in contact with the first stationary contact. At least a part of a neutral plane of the dome-shaped spring has a shape defined by an even function of eighth-order or more. And an angle $\alpha$ of the neutral plane of the dome-shaped spring to the substrate at a second inflection point that exists at a second-positioned inflection point from the circumferential edge to a center of the dome-shaped spring, an angle $\beta$ of the neutral plane of the dome-shaped spring to the substrate at a first inflection point that exists at a first-positioned inflection point from the circumferential edge to a center of the dome-shaped spring, and an angle $\gamma$ of the neutral plane of the dome-shaped spring to the substrate at the circumferential edge of the dome-shaped spring satisfy following inequalities of $\alpha \leq \beta$ and $\beta \geq \gamma$.

Preferably, a part of the dome-shaped spring is cut out.

In accordance with a second aspect of the invention, a switch is provided. The switch is provided with the dome-shaped spring above explained and a substrate for placing the dome-shaped spring. The dome-shaped spring is provided with a movable contact at a center portion thereof, the substrate includes a first stationary contact and a second stationary contact that makes in contact with the movable contact when the dome-shaped spring is buckled. The dome-shaped spring includes a conductor and the first stationary contact and the second stationary contact are electrically conducted via the dome-shaped spring in a buckled state caused by pressing down the dome-shaped spring.

Preferably, the switch includes one of a fixing portion and a spring holding sheet that holds the dome-shaped spring at a predetermined position on the substrate.

Preferably, the switch further includes an operating button for receiving a pressing force and transferring the force as an acting load to the dome-shaped spring.

According to the present invention, it becomes possible to downsize a dome-shaped spring and obtain a click action with reliability, and reduce wear of a circumferential edge of a dome-shaped spring and stationary contacts caused by repeated movements of pressing and releasing of the dome-shaped spring.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

An exemplary embodiment, first and second varieties, and first and second examples will be explained with reference to the attached drawings. The scope of the invention, however, is not limited to the embodiment, varieties and examples.

Embodiment

Figure 1:
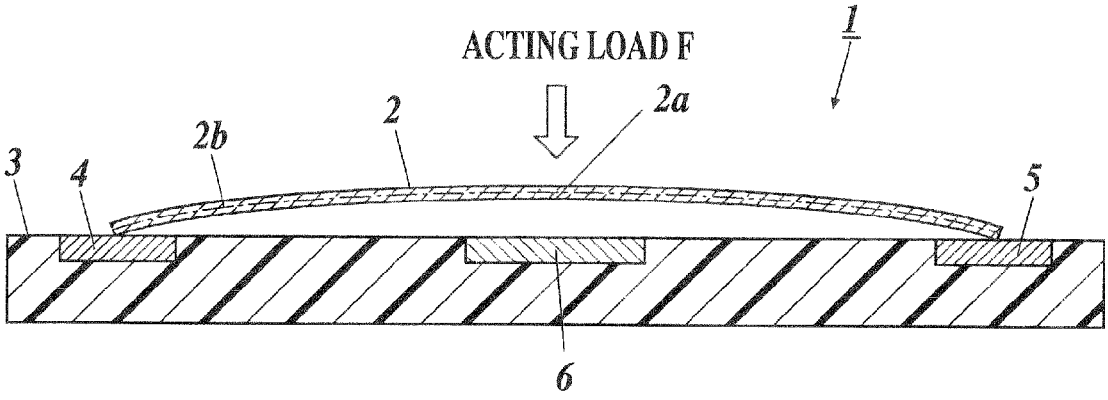
FIG. 1 is a sectional drawing of a switch according to an exemplary embodiment of the present invention.
Figure 2:
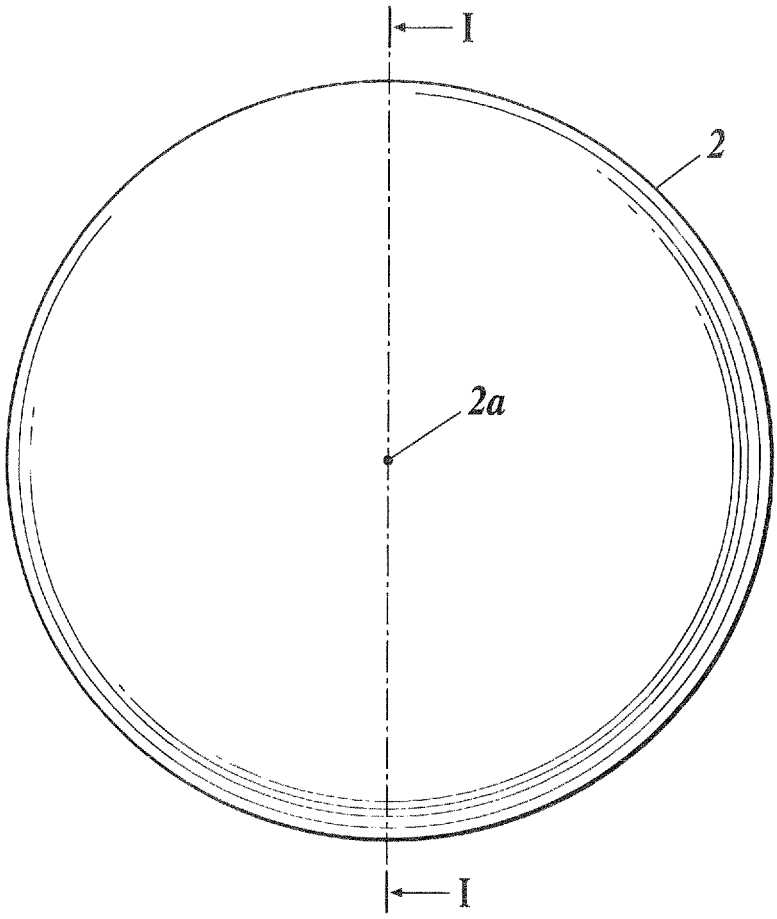
FIG. 2 is a plan view of a dome-shaped spring according to an exemplary embodiment.

An exemplary embodiment of the present invention will be explained with reference to FIGS. 1 to 7. At first, a switch 1 according to an exemplary embodiment will be explained with reference to FIGS. 1 and 2. FIG. 1 is a sectional structure of a switch 1 and FIG. 2 is a planar structure of a dome-shaped spring 2. FIG. 1 shows a sectional drawing including a section of the dome-shaped spring 2 along I-I line in FIG. 2.

The switch 1 of an exemplary embodiment is used for an operating portion of an electronic device, for example. The electronic device is provided with an operating portion for pressing switches and is a mobile phone, PHS (Personal Handyphone System), PDA (Personal Digital Assistant), smart phone, handy game machine, and the like.

As shown in FIG. 1, the switch 1 is provided with a dome-shaped spring 2, substrate 3, and stationary contacts 4, 5, 6. The dome-shaped spring 2 is a spring for a contact made of conducting metal having a shape of aspheric dome as a whole. A material for the dome-shaped spring 2 is a conducting metal such as a stainless steel such as SUS 301 (stainless steel strip for spring), copper-beryllium, phosphor-bronze for spring, and the like. However, it is not limited to these materials but any material can be used as far as it is generally used for a spring.

As shown in FIG. 2, the dome-shaped spring 2 has a circular shape in a plan view. A plane center of the dome-shaped spring 2 is a movable contact 2*a*. A neutral plane, which is shown in the cross-section of the dome-shaped spring 2, is designated as a neutral plane 2*b*. A "neutral plane" is a plane existing at a boundary of a compressed side and a tensile side, and is not stretched nor compressed. In the dome-shaped spring 2, the neutral plane has the aspheric shape. The aspheric shape of the dome-shaped spring 2 will be explained later in detail. The dome-shaped spring 2 has a convex shape expanding to the reverse direction of a pressing-down direction by a user.

The substrate 3 is a substrate made of glass-epoxy resin, for example. The dome-shaped spring 2 is placed on the substrate 3. The substrate 3 is provided with stationary contacts 4, 5 and 6. The stationary contacts 4, 5 and 6 are fixed electric contacts made of conducting metal such as a copper foil. The stationary contacts 4 and 5 contact-support a circumferential edge of the dome-shaped spring 2 continuously. The stationary contact 6 is formed at a position corresponding to a movable contact 2*a* of the dome-shaped spring 2. The stationary contact 6 is not in contact with the dome-shaped spring 2 in a state when the dome-shaped spring 2 is not pressed down (no acting load F is applied) by a user. The surface of the substrate 3 and the stationary contacts 4, 5, 6 is flat (common).

Figure 3:
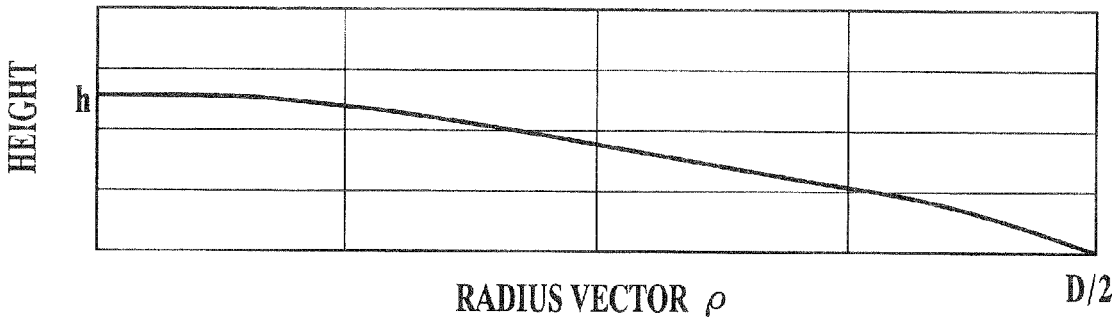
FIG. 3 is a graph showing a height to a radius vector of a dome-shaped spring according to an exemplary embodiment.
Figure 4:
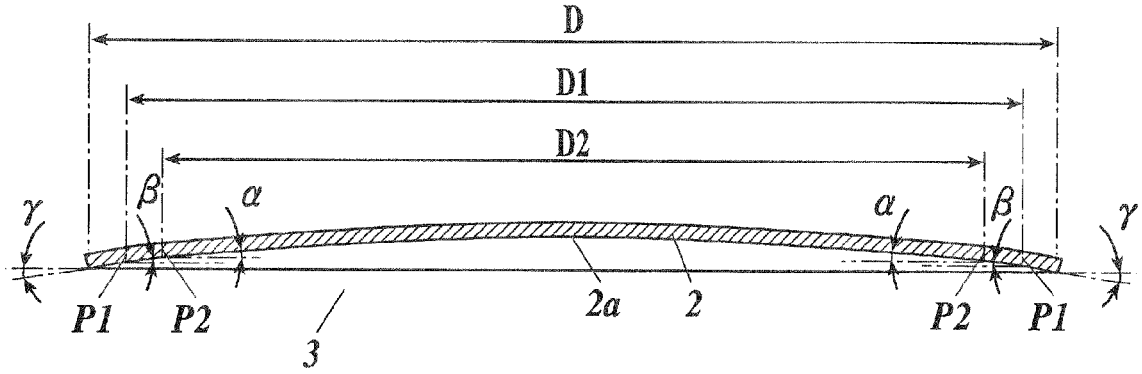
FIG. 4 illustrates a sectional shape of a dome-shaped spring according to an exemplary embodiment.

Next, an aspheric shape of the dome-shaped spring 2 will be explained with reference to FIGS. 3 and 4. FIG. 3 shows a relation between a height of a dome-shaped spring 2 and a radius vector ρ. FIG. 4 shows a shape of the dome-shaped spring 2.

As shown in FIGS. 3 and 4, the dome-shaped spring 2 is designed to be an aspheric shape. The height of the dome-shaped spring 2 indicated in FIG. 3 is a vertical distance from the placing surface (surface of the substrate 3) to an underside surface of the dome-shaped spring 2. A circle having a diameter of D is assumed whose center is a point on a plane (placing surface (surface of the substrate 3)) of the dome-shaped spring 2 corresponding to the plane center of the dome-shaped spring 2 and whose radius is a length from the point of the plane center to a contacting point of the circumferential edge with the substrate 3. The radius vector ρ is defined as a length on the plane from the point corresponding to the plane center of the dome-shaped spring 2. That is, the radius vector ρ corresponding to a point of the diameter D is D/2. A height of the dome-shaped spring 2 at the center position thereof is assumed h.

The dome-shaped spring 2 has similar aspheric shapes at upper side plane, neutral plane and underside plane. And at least the neutral plane has an aspheric shape defined as follows. Therefore, the shape of the underside plane of the dome-shaped spring 2 is assumed to be the shape of the neutral plane of the dome-shaped spring 2 hereinafter.

The aspheric shape of the neutral plane of the dome-shaped spring 2 is a shape expressed by an aspheric equation of an eighth-order even function expressed by the following equation (3).

$$f(\rho)=a_1\cdot\rho^8+a_2\cdot\rho^6+a_3\cdot\rho^4+a_4\cdot\rho^2+h \quad (3)$$

where $a_1$, $a_2$, $a_3$ and $a_4$ are coefficients.

Among inflection points of the equation (3), as shown in FIG. 4, a first inflection point positioned inside from the circumferential edge of the dome-shaped spring 2 toward the center thereof is defined as P1 and a second inflection point positioned inside from the circumferential edge of the dome-shaped spring 2 toward the center thereof is defined as P2. A circle is assumed whose center is a point on the placing plane (surface of the substrate 3) corresponding to the plane center of the dome-shaped spring 2 and whose circumference is the inflection point P1, and the diameter of the circle is defined as D1. Another circle is also assumed whose center is the point on the placing plane (surface of the substrate 3) corresponding to the plane center of the dome-shaped spring 2 and whose circumference is the inflection point P2, and the diameter of the circle is defined as D2.

In connection with the outer diameter D, an angle of the neutral plane of the dome-shaped spring 2 at the circumferential edge of the dome-shaped spring 2 to the surface of the substrate 3 (placing plane of the dome-shaped spring 2) is defined as γ. In connection with the diameter D1, an angle of the neutral plane of the dome-shaped spring 2 at the inflection point P1 to the surface of the substrate 3 (placing plane of the dome-shaped spring 2) is defined as β. In connection with the diameter D2, an angle of the neutral plane of the dome-shaped spring 2 at the inflection point P2 to the surface (placing plane of the dome-shaped spring 2) of the substrate 3 (stationary contacts 4 and 5) is defined as α.

It is necessary for the dome-shaped spring 2 to satisfy following inequalities (4) and (5).

$$\alpha\leq\beta \quad (4)$$

$$\beta\geq\gamma \quad (5)$$

The coefficients $a_1$, $a_2$, $a_3$ and $a_4$ in the equation (3) are determined so as to satisfy the inequalities (4) and (5).

The reason why the eighth-order even function is used for the equation (3) is to obtain two inflection points between the point the radius vector ρ is 0 (a point corresponding to the plane center of the dome-shaped spring 2) and the point the radius vector ρ is D/2 (a point corresponding to the circumferential edge of the dome-shaped spring 2). The two inflection points other than the points the radius vector ρ is 0 and D/2 are P1 and P2.

The condition inequalities (4) and (5) for the equation (3) define conditions to occur buckling of the dome-shaped spring 2 and to reduce radial displacement of the circumferential edge of the dome-shaped spring 2 contacting with the stationary contacts 4 and 5 caused by the repeated movement of press down and release of the dome-shaped spring 2. The dome-shaped spring 2 is designed so as to satisfy the equations (3), (4) and (5).

The equation (3) defines the aspheric shape of the neutral plane 2*b* of the dome-shaped spring 2 in an eighth-order even function. However, it may be 10th or more order even function. Following equation (6) is a 10th-order even function, for example.

$$f(\rho)=a_1\cdot\rho^{10}+a_2\cdot\rho^8+a_3\cdot\rho^6+a_4\cdot\rho^4+a_5\cdot\rho^2+h \quad (6)$$

As a conclusion, the aspheric shape of the dome-shaped spring 2 of an exemplary embodiment is expressed as the following general equation (7).

$$f(\rho)=a_1\cdot\rho^n+a_2\cdot\rho^{n-2}+a_3\cdot\rho^{n-4}+\ldots+a_{n/2}\cdot\rho^2+h \quad (7)$$

where n is an even number of eight or more and $a_1$ to $a_{n/2}$ are coefficients.

When designing the dome-shaped spring 2, the higher the order number n of the equation (7), the more ideal the aspheric shape can be designed. However, the more calculation is needed, thus it is preferable to select an aspheric equation of appropriate number of order such as eight to design the aspheric shape of the dome-shaped spring 2.

Figure 5A:
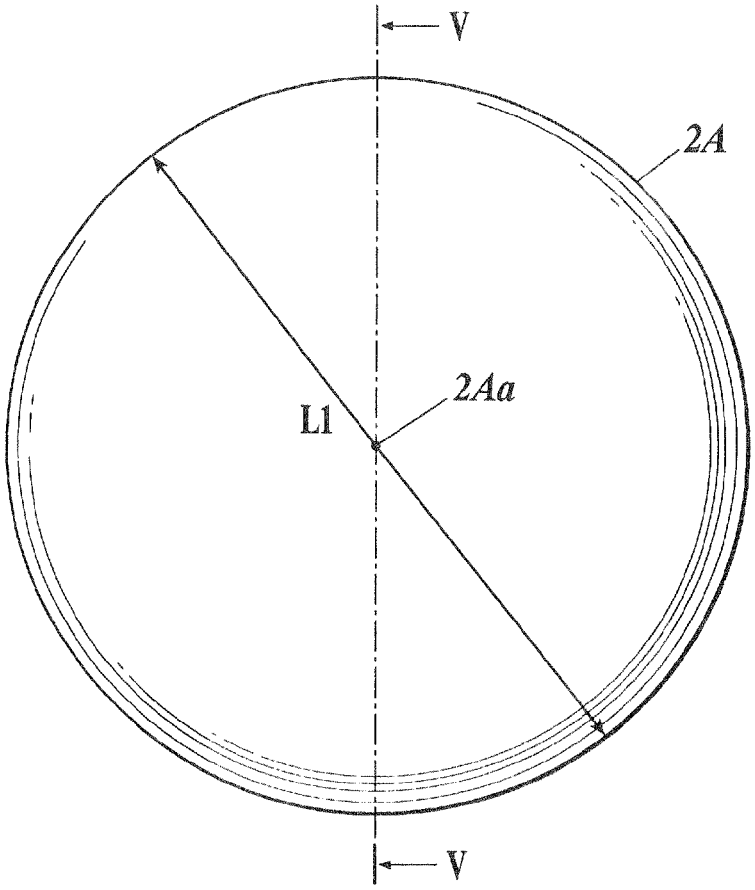
FIG. 5A is a plan view of a dome-shaped spring according to an exemplary embodiment.
Figure 5B:
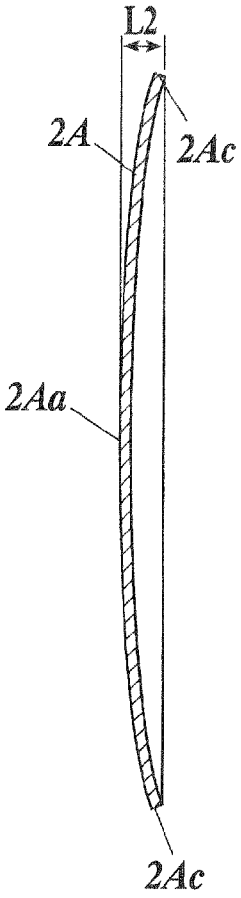
FIG. 5B is a sectional view of a dome-shaped spring according to an exemplary embodiment.

Next, an example of an action of the dome-shaped spring 2 will be explained with reference to FIGS. 5 to 7. FIG. 5A is a plan view of a dome-shaped spring 2A according to an exemplary embodiment. FIG. 5B is a sectional structure of the dome-shaped spring 2A.

The dome-shaped spring 2A shown in FIGS. 5A and 5B is an example of a dome-shaped spring 2 designed by the formulas (3), (4) and (5). FIG. 5B is a sectional structure of the dome-shaped spring 2A along V-V line shown in FIG. 5A.

A diameter of the dome-shaped spring 2A in the planar view is L1 and a height from a substrate to a top surface of the dome-shaped spring 2A in the sectional view is L2. A plane center of the dome-shaped spring 2A is designated as a movable contact 2Aa. A circumferential edge of the dome-shaped spring 2A on the plane is designated as a circumferential edge 2Ac.

Figure 6:
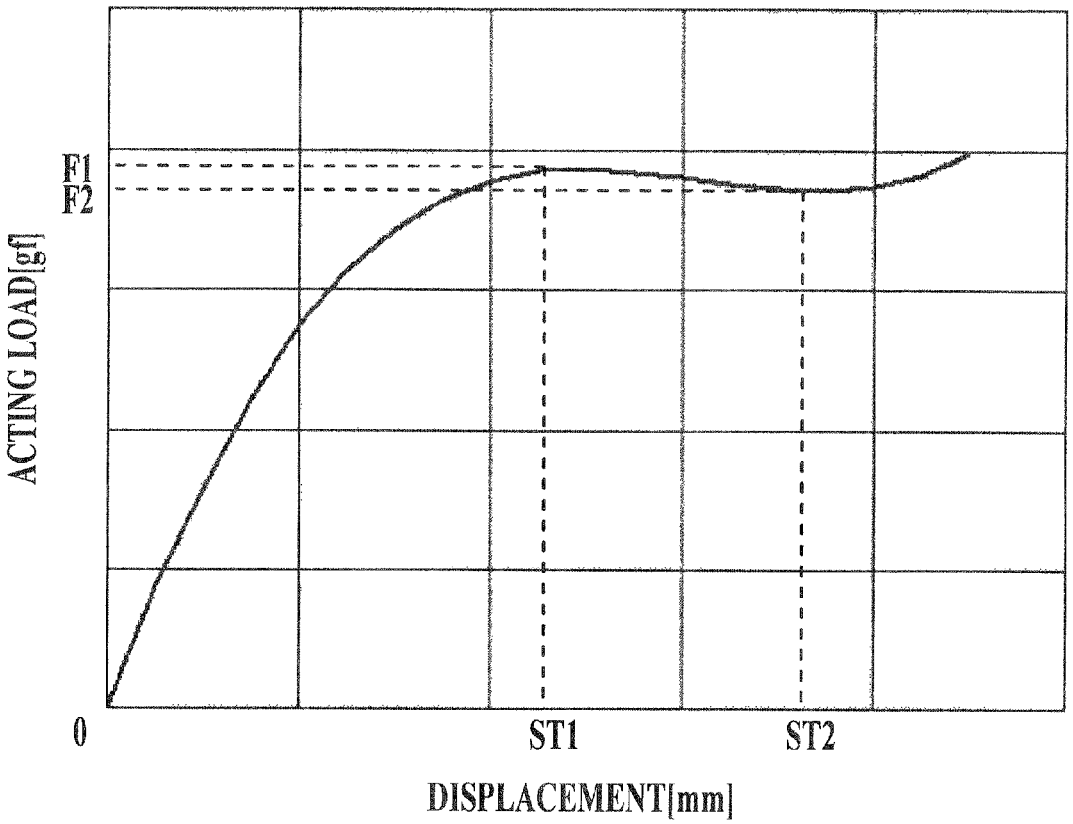
FIG. 6 is a graph showing an acting load to displacement characteristic of a dome-shaped spring according to an exemplary embodiment.

FIG. 6 shows a displacement characteristic of the dome-shaped spring 2A to an acting load. FIG. 6 shows a solid curve of an acting load F (gf) to a vertical displacement (mm) of the movable contact 2Aa from the substrate 3 of the dome-shaped spring 2A. FIG. 6 is an example of the dome-shaped spring 2A having sizes of L1=4 (mm) and L2=0.19 (mm).

Let us assume that a user presses the movable contact 2Aa of a switch, which has the dome-shaped spring 2A, with an acting load F. The movable contact 2Aa is provided at a center of the dome-shaped spring 2A. The acting load and displacement at the initial state, with no applied load to the movable contact 2Aa, is zero.

A user starts applying an acting load F by pressing the movable contact 2Aa from the initial state of the switch. As shown in FIG. 6, the acting load is increased nearly proportionally from zero to point ST1 by displacement. The dome-shaped spring 2A will buckle at an acting load F1 corresponding to a displacement point ST1. Then a central portion of the dome-shaped spring 2A including the movable contact 2Aa reverses and the movable contact 2Aa displaces with less load than the acting load F1. After that the acting load continues decreasing until the movable contact 2Aa reaches a displacement point ST2. The movable contact 2Aa of the dome-shaped spring 2A makes contact with the stationary contact 6 at the displacement point ST2, resulting in an electrical conduction between the stationary contacts 4 and 5 and the stationary contact 6 via the dome-shaped spring 2A. A position of the movable contact 2Aa to be contact with the stationary contact 6 may be set between the displacement points ST1 and ST2. When the user releases exerting the acting load F to the movable contact 2Aa, the dome-shaped spring 2A returns to the initial state.

Figure 7:
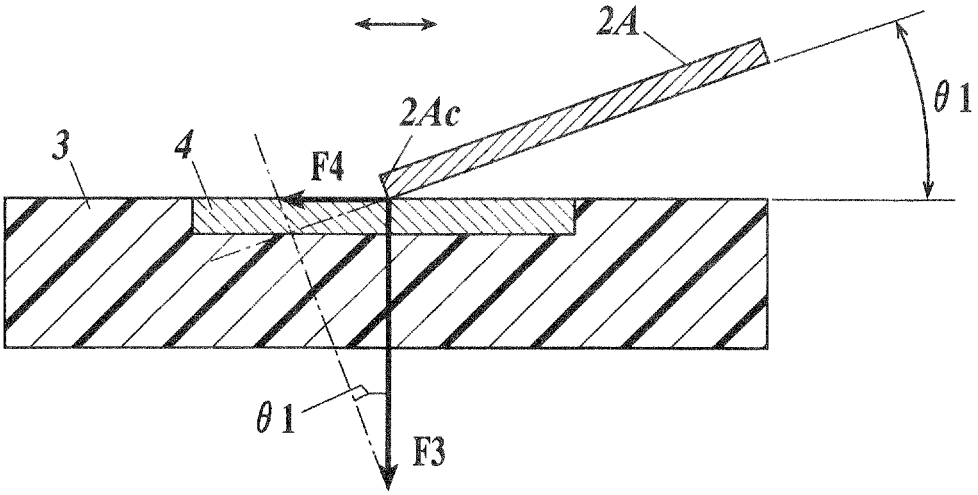
FIG. 7 illustrates a contacting of a circumferential edge and a stationary contact of a dome-shaped spring according to an exemplary embodiment.

FIG. 7 shows a contact of the circumferential edge 2Ac of the dome-shaped spring 2A with the stationary contact 4. During the repeated action of the press-down of the dome-shaped spring 2A and release thereof, the circumferential edge 2Ac of the dome-shaped spring 2A displaces side to side repeatedly while contacting with the stationary contact 4. Under the repeated movement, an angle of the circumferential edge 2Ac of the dome-shaped spring 2A to the substrate 3 (stationary contact 4) is designated as θ1. By pressing down the dome-shaped spring 2A, the stationary contact 4 receives a force from the dome-shaped spring 2A at the contacting portion of the stationary contact 4 and the circumferential edge 2Ac.

By vector decomposing of the force that the stationary contact 4 receives from the dome-shaped spring 2A, a vertical force F3 and a force F4, which is calculated by F3·tan(θ1), to the radius vector (contacting direction) are obtained. Since the dome-shaped spring 2A is designed such that the angle γ becomes small, the force F4 to the radius vector can be reduced by reducing the angle θ1. In the repeated movement of the pressing down of the dome-shaped spring 2A and release thereof, because the angle of the circumferential edge 2Ac of the dome-shaped spring 2A to the stationary contact 4 is made near parallel and the contact between the circumferential edge 2Ac and the stationary contact 4 becomes near surface contact, the displacement of the circumferential edge 2Ac to the radius vector can be reduced and wearing of the circumferential edge 2Ac and the stationary contact 4 can be suppressed by reducing the force F4 to the radius vector. The contact between the circumferential edge 2Ac of the dome-shaped spring 2A and the stationary contact 5 is in analogous fashion.

According to an exemplary embodiment above explained, the switch 1 is disposed on the substrate 3 having the stationary contacts 4 and 5, and is provided with the dome-shaped spring 2 whose circumferential edge is continuously in contact with the stationary contacts 4 and 5, and the neutral plane 2*b* has the shape defined by the equation (3) and the even function (6) or (7) of eighth-order or more. The angle α of the neutral plane 2*b* to the substrate 3 at the inflection point P2, the angle β of the neutral plane 2*b* to the substrate 3 at the inflection point P1 and the angle γ of the neutral plane 2*b* to the substrate 3 at the circumferential edge satisfy the equations (4) and (5). As a result, it becomes possible to reduce the sizes of the dome-shaped spring 2 and the switch 1 while a tactile (click) action can be obtained with reliability. Furthermore, it becomes possible to reduce wear of a circumferential edge of the dome-shaped spring 2 and the stationary contacts 4 and 5 caused by repeated movements of pressing down and releasing of the dome-shaped spring 2.

(First Variety)

Figure 8:
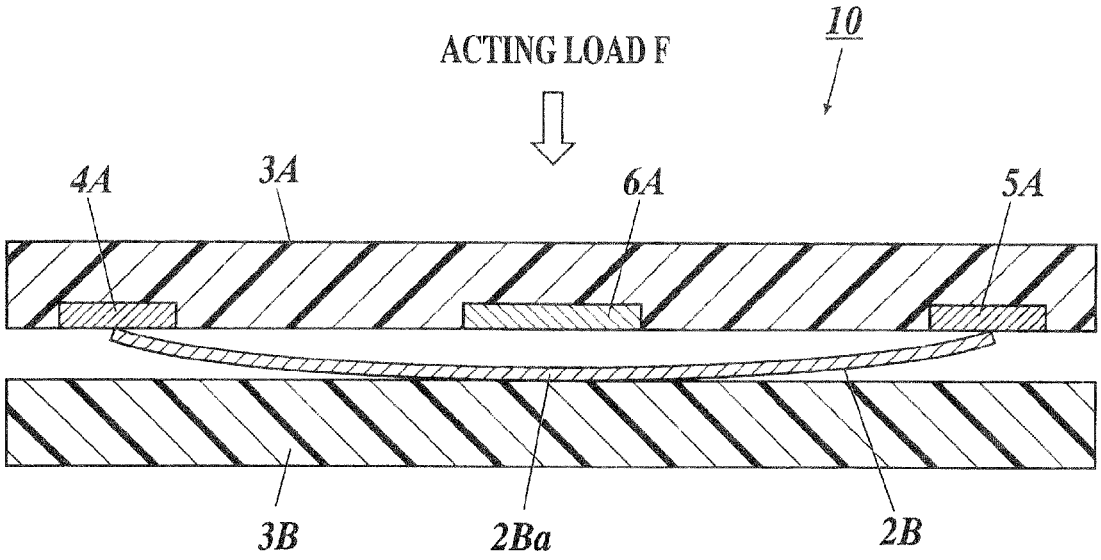
FIG. 8 is a sectional view of a switch according to a first variety.

A first variety of an exemplary embodiment will be explained with reference to FIG. 8. FIG. 8 shows a cross-sectional structure of a switch 10 according to a first variety.

The switch 1 according to an exemplary embodiment includes the dome-shaped spring 2 having a convex shape expanding in the reverse direction of a direction that a user presses down the dome-shaped spring 2. To the contrary, the switch 10 of a first variety includes a dome-shaped spring 2B, as an example of a dome-shaped spring 2, having a convex shape expanding in the same direction of pressing down the spring.

As shown in FIG. 8, the switch 10 has the dome-shaped spring 2B, substrates 3A and 3B, and stationary contacts 4A, 5A and 6A. The dome-shaped spring 2B is a dome-shaped spring as a contact made of conducting metal such as a SUS whose neutral plane is an aspheric plane as the dome-shaped spring 2. A planar shape of the dome-shaped spring 2B is circular. A center point (plane center) of the circle of the dome-shaped spring 2B is designated as a movable contact 2Ba.

The substrates 3A and 3B are substrates made of, for example, glass-epoxy resin. The substrate 3A is arranged on the dome-shaped spring 2B and is carried by the dome-shaped spring 2B. The substrate 3B is arranged under the dome-shaped spring 2B and the dome-shaped spring 2B is placed thereon. The substrate 3A is provided with stationary contacts 4A, 5A and 6A. The stationary contacts 4A, 5A and 6A are electric contacts made of conducting metal such as a copper foil. The stationary contacts 4A and 5A are continuously in contact with a circumferential edge of the dome-shaped spring 2B. The stationary contact 6A is arranged at a position corresponding to the movable contact 2Ba of the dome-shaped spring 2B. The stationary contact 6A is not in contact with the dome-shaped spring 2B when the dome-shaped spring 2B is not pressed down. The substrate 3B is in contact with the movable contact 2Ba when the dome-shaped spring 2B is not pressed down.

From the initial state without acting load F, by adding acting load F onto the movable contact 2Ba by pressing down the dome-shaped spring 2B, the dome-shaped spring 2B of the switch 10, as the switch 1, buckles at some point of displacement and the center portion reverses to cause a click action, and the movable contact 2Ba becomes in contact with the stationary contact 6A. When the acting load F be removed by releasing press-down of the dome-shaped spring 2B, the dome-shaped spring 2B returns to its initial state.

According to a first variety, the switch 10 includes the dome-shaped spring 2B and, as an exemplary embodiment, it becomes possible to reduce the sizes of the dome-shaped spring 2B and thus the switch 10 while a click action can be obtained with reliability. Furthermore, it becomes possible to reduce wear of a circumferential edge of the dome-shaped spring 2B and the stationary contacts 4A and 5A caused by repeated movements of pressing down and releasing of the dome-shaped spring 2.

The stationary contacts 4A, 5A and 6A are provided on the substrate 3A. Therefore, the stationary contacts 4A, 5A and 6A can be arranged over (on the side to press down) the dome-shaped spring 2B.

(Second Variety)

Figure 9A:
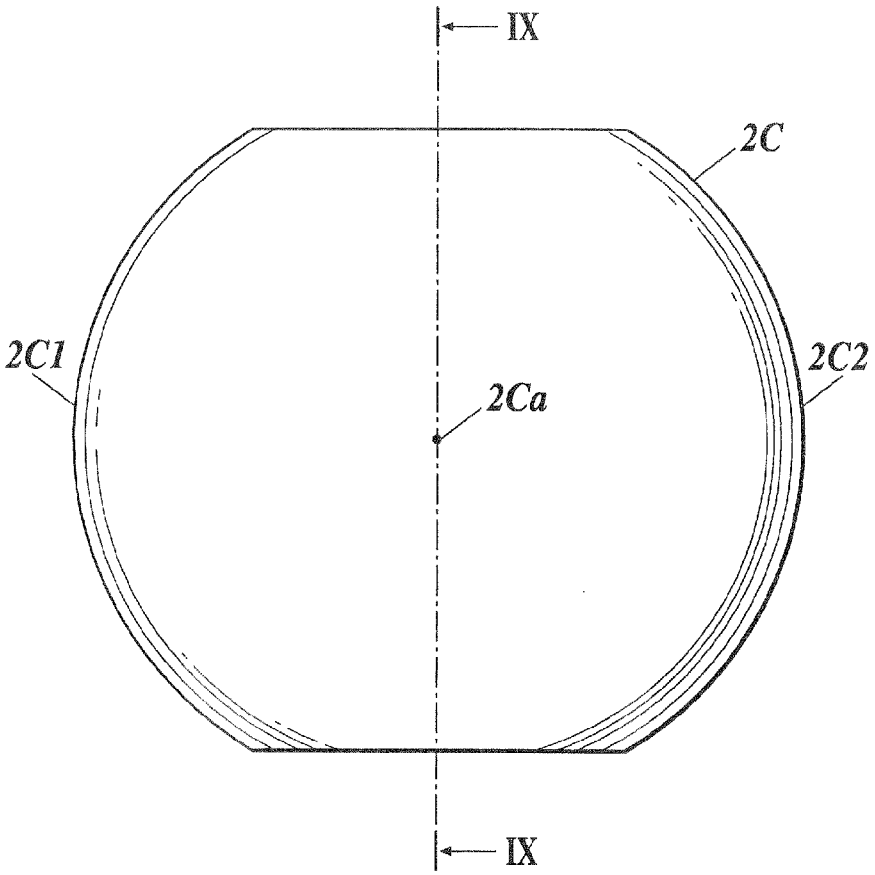
FIG. 9A is a plan view of a first dome-shaped spring according to a second variety.
Figure 9B:
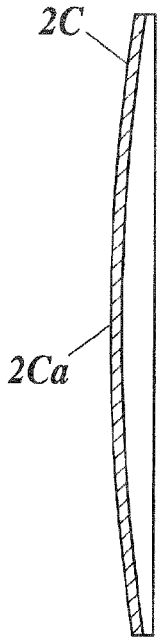
FIG. 9B is a sectional view of a first dome-shaped spring according to a second variety.
Figure 10A:
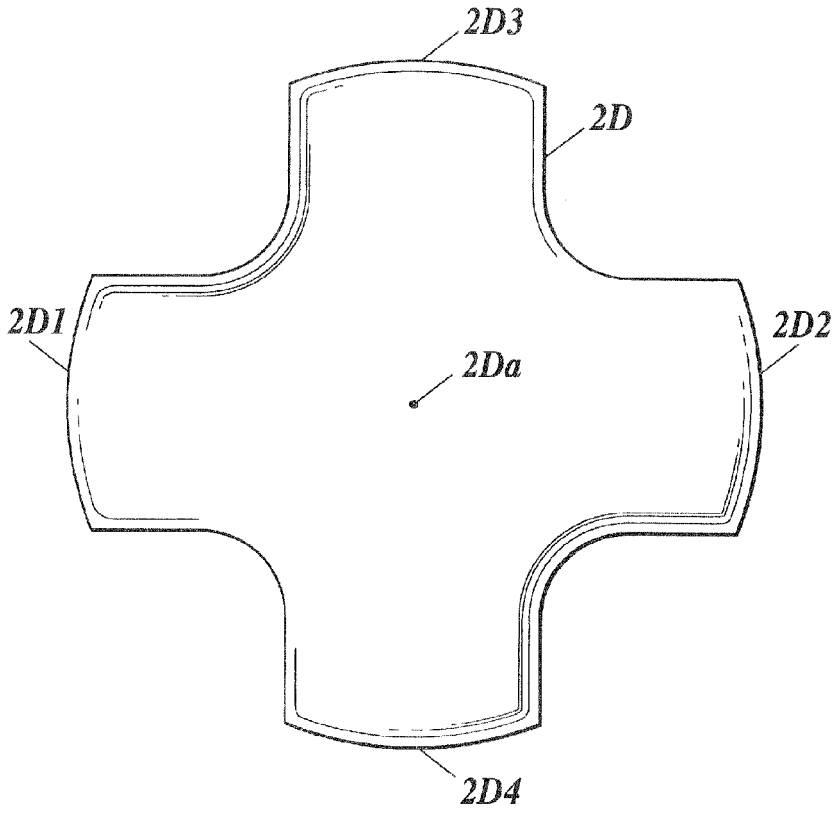
FIG. 10A is a plan view of a second dome-shaped spring according to a second variety.
Figure 10B:
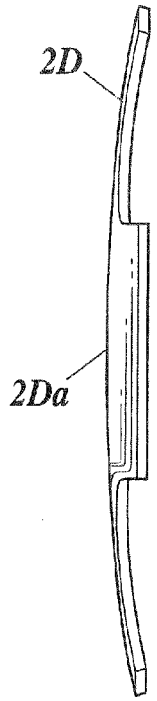
FIG. 10B is a side view of a second dome-shaped spring according to a second variety.
Figure 11A:
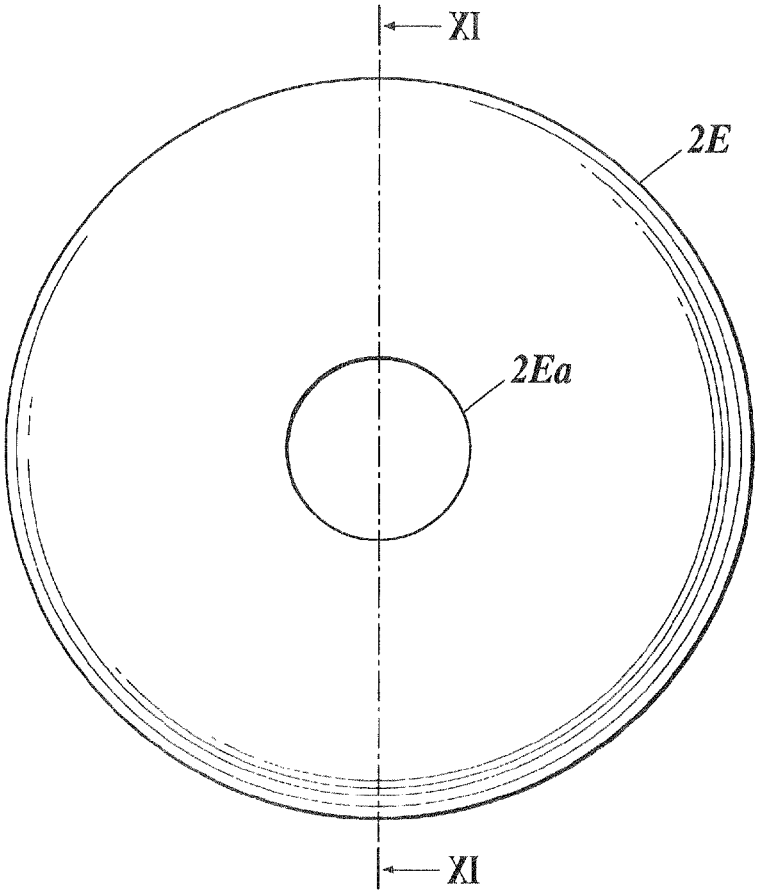
FIG. 11A is a plan view of a third dome-shaped spring according to a second variety.
Figure 11B:
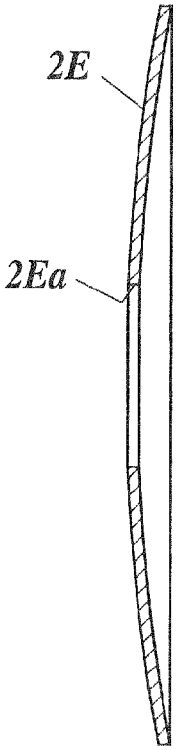
FIG. 11B is a sectional view of a third dome-shaped spring according to a second variety.

A second variety of an exemplary embodiment will be explained with reference to FIGS. 9 to 11. FIG. 9A is a planar structure of a dome-shaped spring 2C of a second variety. FIG. 9B is a cross-sectional structure of the dome-shaped spring 2C. FIG. 10A is a planar structure of a dome-shaped spring 2D of a second variety. FIG. 10B is a side view of the dome-shaped spring 2D. FIG. 11A is a planar structure of a dome-shaped spring 2E of a second variety. FIG. 11B is a cross-sectional structure of the dome-shaped spring 2E.

The switch 1 of an exemplary embodiment has the dome-shaped spring 2 whose plan shape is a circle. The switch of a second variety has, instead of the dome-shaped spring 2, the dome-shaped spring 2C, 2D or 2E of which a part is cut out.

The dome-shaped spring 2C, as shown in FIGS. 9A and 9B, has a sack shape which top and bottom portions are cut out from the planar circle shape. FIG. 9B is a cross-sectional view along IX-IX line of the dome-shaped spring 2C in FIG. 9A. The dome-shaped spring 2C is fabricated by cutting top and bottom portions of the dome-shaped spring 2. Thus the dome-shaped spring 2C has an aspheric shape as the dome-shaped spring 2. In this connection of the dome-shaped spring 2C, two circumferential edge points 2C1 and 2C2, existing in a remained region and opposing across the central movable contact 2Ca, are in contact with the stationary contacts 4 and 5 of the substrate 3.

The dome-shaped spring 2D, as shown in FIGS. 10A and 10B, has a shape of a cross dome in which four edges of a dome are cut out. FIG. 10B is a side view of the dome-shaped spring 2D shown in FIG. 10A. The dome-shaped spring 2D is fabricated by cutting four edge portions of the dome-shaped spring 2. Thus the dome-shaped spring 2D has an aspheric shape as the dome-shaped spring 2. In this connection of the dome-shaped spring 2D, two circumferential edge points 2D1 and 2D2 or 2D3 and 2D4 among four circumferential edge points, existing in a remained region and opposing across the central movable contact 2Ca, are in contact with the stationary contacts 4 and 5 of the substrate 3.

The dome-shaped spring 2E, as shown in FIGS. 11A and 11B, has a shape of perforated dome which a center portion is cut out from the dome shape. FIG. 11B is a cross-sectional view along XI-XI line of the dome-shaped spring 2E in FIG. 11A. The dome-shaped spring 2E is fabricated by roundly perforating the center of the dome-shaped spring 2. An edge portion of the perforated hole of the dome becomes a movable contact 2Ea. Thus the dome-shaped spring 2E has an aspheric shape as the dome-shaped spring 2. In this connection of the dome-shaped spring 2E, as the dome-shaped spring 2, two circumferential edge points opposing across the central movable contact 2Ea are in contact with the stationary contacts 4 and 5 of the substrate 3. The stationary contact 6 is formed and arranged at a position so as to contact with the movable contact 2Ea when the dome-shaped spring 2E buckled.

According to a second variety, as an exemplary embodiment, it becomes possible to reduce the sizes of the dome-shaped spring 2C, 2D or 2E and a switch using the same while a click action can be obtained with reliability. Furthermore, it becomes possible to reduce wear of a circumferential edge of the dome-shaped spring 2C, 2D or 2E and the stationary contacts caused by repeated movements of pressing down and releasing of the dome-shaped spring 2C, 2D or 2E.

The dome-shaped spring 2C, 2D or 2E is cut out in its part. Therefore, amount of material can be reduced and it contributes to weight reduction of the dome-shaped spring and a switch using the same.

FIRST EXAMPLE

Figure 12:
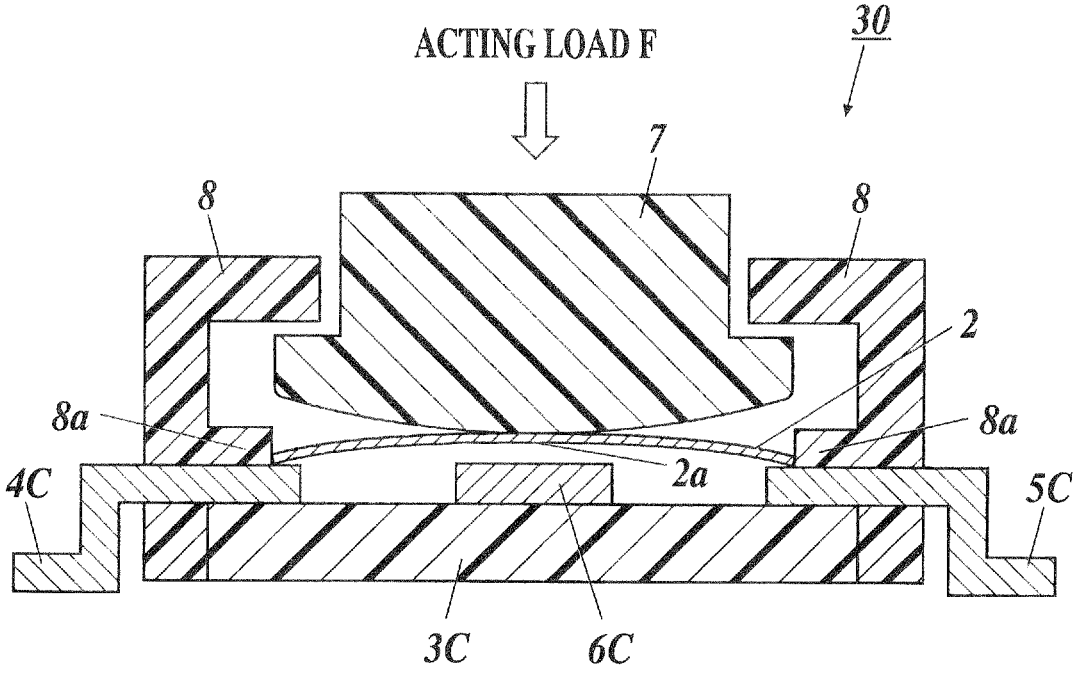
FIG. 12 is a sectional view of a switch according to a first example.

A switch 30 according to a first example of the switch 1 of an exemplary embodiment will be explained with reference to FIG. 12. FIG. 12 shows a cross-sectional structure of a switch 30 according to a first example.

The switch 30 is a button switch used as a part of an operating portion of a mobile equipment, for example. The switch 30 is provided with a dome-shaped spring 2, substrate 3C, stationary contacts 4C, 5C and 6C, operating button 7 and switch case 8. The substrate 3C and stationary contacts 4C, 5C and 6C correspond to the substrate 3, stationary contacts 4, 5 and 6 of an exemplary embodiment, respectively. The same number is designated to the same member as an exemplary embodiment and the explanation for them will be omitted hereinafter.

The substrate 3C is made of glass-epoxy resin, for example. The stationary contacts 4*c*, 5*c* and 6*c* are disposed on the substrate 3. The stationary contacts 4*c*, 5*c* and 6*c* are electric contacts made of conducting metal such as a copper foil. The stationary contacts 4*c*, 5*c* and 6*c* are continuously in contact with a circumferential edge of the dome-shaped spring 2. The stationary contact 6C is arranged at a position corresponding to a movable contact 2*a* of the dome-shaped spring 2. The stationary contact 6C is not in contact with the dome-shaped spring 2 when the dome-shaped spring 2 is not pressed down.

The operating button 7 is made of resin such as an ABS resin and is used for a user to press down. The operating button 7 is in contact with a top portion of the dome-shaped spring 2 and receives an inputting (pressing) force by the user. The button 7 moves up and down along the switch case 8 in accordance with the pressing force and transmits an acting load F corresponding to the pressing force to the dome-shaped spring 2. The switch case 8 is made of resin such as a plastic. The switch case 8 covers the dome-shaped spring 2, substrate 3C, stationary contacts 4C, 5C and 6C and operating button 7 while a part of the operating button 7 is exposed. The switch case 8 guides the operating button 7 in upper and lower directions.

The switch case 8 includes a fixing portion 8*a*. The fixing portion 8*a* has a role to fix (hold) a position of the dome-shaped spring 2 on the substrate 3C in a plan view. The position is defined such that the dome-shaped spring 2 is in contact with the stationary contacts 4C and 5C and the movable contact 2*a* of the dome-shaped spring 2 makes in contact with the stationary contact 6C when the dome-shaped spring 2 buckled. The dome-shaped spring 2 displaces side to side at the position while the circumferential edge is in contact with the stationary contacts 4C and 5C by pressing down the operating button 7 and releasing it.

According to a first example, the switch 30 includes the dome-shaped spring 2 and, as an exemplary embodiment, it becomes possible to reduce the sizes of the dome-shaped spring 2 and the switch 30 while a click action can be obtained with reliability. Furthermore, it becomes possible to reduce wear of a circumferential edge of the dome-shaped spring 2 and the stationary contacts 4C and 5C caused by repeated movements of pressing down and releasing of the dome-shaped spring 2. In addition, the switch 30 includes the operating button 7 and thus a user can perform the press down operation easily.

The switch 30 is provided with the switch case 8 having the fixing portion 8*a*. Therefore, the dome-shaped spring 2 is caused to be continuously in contact with the stationary contact 4C and 5C and is certainly located at the position that helps to make contact with the stationary contact 6C, by the fixing portion 8*a*, when the dome-shaped spring 2 buckled.

SECOND EXAMPLE

Figure 13:
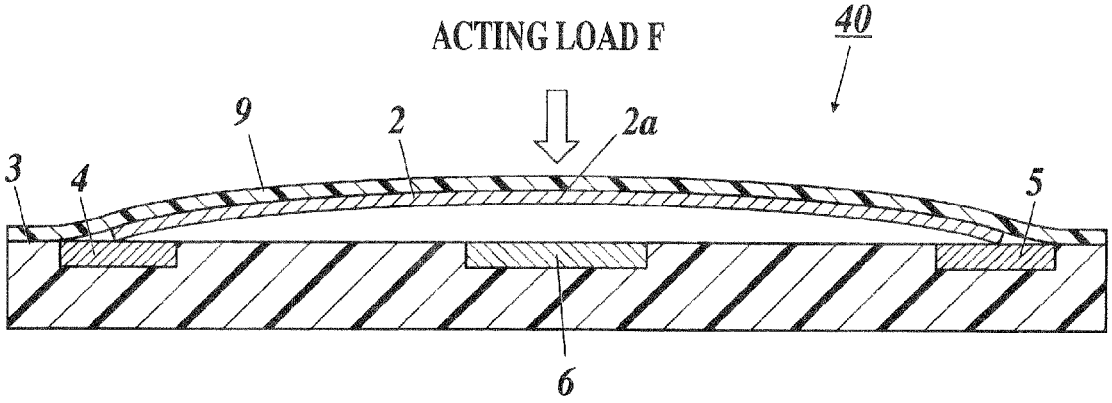
FIG. 13 is a sectional view of a switch according to a second example.

A switch 40 according to a second example of the switch 1 of an exemplary embodiment will be explained with reference to FIG. 13. FIG. 13 shows a cross-sectional structure of a switch 40 according to a second example.

The switch 40 is a button switch used as a part for such as an operating portion of a mobile equipment, for example. The switch 40 is provided with a dome-shaped spring 2, substrate 3, stationary contacts 4, 5 and 6, and spring holding sheet 9.

The spring holding sheet 9 is an insulation sheet made by a polyester film, for example. The spring holding sheet 9 is attached on the surface of the dome-shaped spring 2 and the substrate 3. The spring holding sheet 9 has a role to fix a position of the dome-shaped spring 2 on the substrate 3 in a plan view. The position is defined such that the dome-shaped spring 2 is in contact with the stationary contacts 4 and 5 and the movable contact 2*a* of the dome-shaped spring 2 makes in contact with the stationary contact 6 when the dome-shaped spring 2 buckled. The dome-shaped spring 2 displaces side to side at the position fixed (held) by the spring holding sheet 9 while the circumferential edge keeps in contact with the stationary contacts 4 and 5 by pressing down the dome-shaped spring 2 and releasing it.

According to a second example, the switch 40 includes the dome-shaped spring 2 and, as an exemplary embodiment, it becomes possible to reduce the sizes of the dome-shaped spring 2 and the switch 40 while a click action can be obtained with reliability. Furthermore, it becomes possible to reduce wear of a circumferential edge of the dome-shaped spring 2 and the stationary contacts 4 and 5 caused by repeated movements of pressing down and releasing of the dome-shaped spring 2.

The switch 40 is provided with the spring holding sheet 9. Therefore, the dome-shaped spring 2 is caused to be continuously in contact with the stationary contact 4 and 5. In addition, the switch 40 can be smaller in height than the switch 30 of a first example and be downsized by using the spring holding sheet 9.

An exemplary embodiment, varieties and examples above explained are mere examples of a dome-shaped spring and a switch of the present invention and are not for limiting the present invention.

Figure 14:
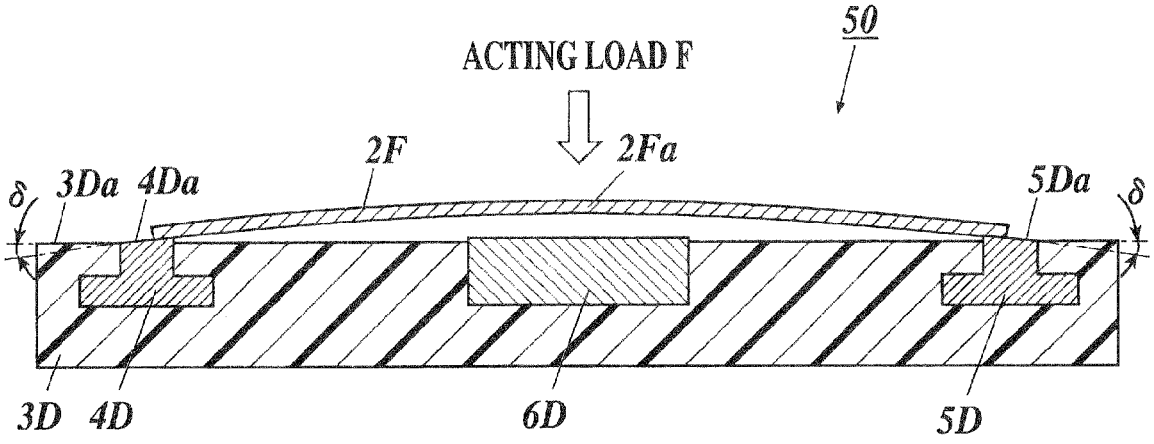
FIG. 14 is a sectional view of a switch according to another variety.

FIG. 14 shows a cross sectional structure of a switch 50 as another variety of an exemplary embodiment. As shown in FIG. 14, the switch 50 includes a dome-shaped spring 2F, substrate 3D, and stationary contacts 4D, 5D and 6D.

Figure 15:
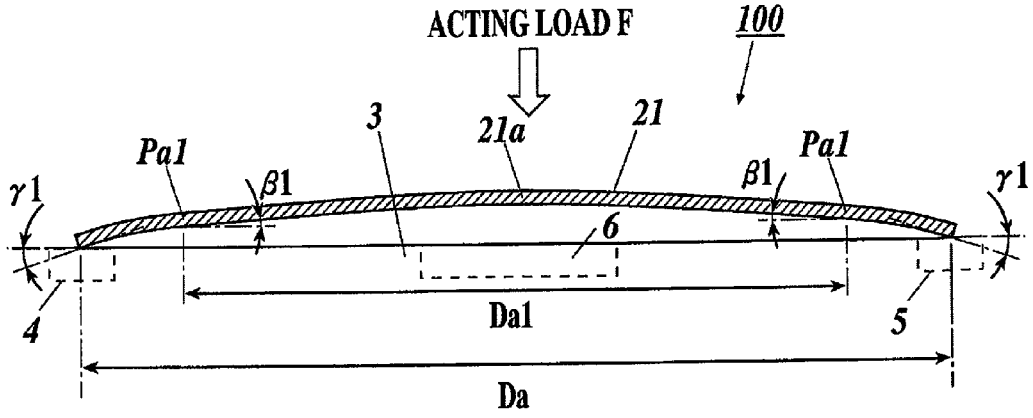
FIG.15 PRIOR ART
FIG. 15 is a sectional view of a conventional switch.
Figure 16:
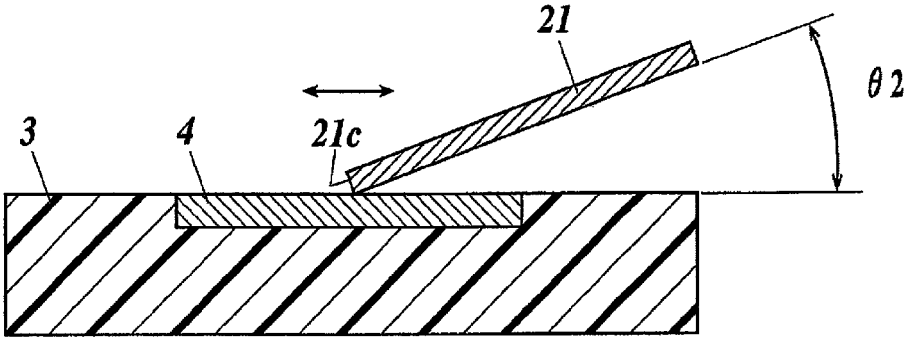
FIG.16 PRIOR ART
FIG. 16 illustrates a contacting of a circumferential edge and a stationary contact of a conventional dome-shaped spring.

The dome-shaped spring 2F is a dome-shaped spring similar to the dome-shaped spring 21 of FIG. 15 explained as a conventional art. That is, the dome-shaped spring 2F has a shape whose neutral plane satisfies the equations (1) and (2), and is made of conducting metal such as a SUS. A plane center of the dome-shaped spring 2F is designated as a movable contact 2Fa.

The substrate 3D is made of glass-epoxy resin, for example. The substrate 3D is provided with the stationary contacts 4D, 5D and 6D. The stationary contacts 4D, 5D and 6D are electric contacts made of metal conductor such as a copper foil. The stationary contacts 4D and 5D are continuously in contact with the circumferential edge of the dome-shaped spring 2F. The stationary contact 6D is formed at a position corresponding to the movable contact 2Fa of the dome-shaped spring 2F. The stationary contact 6D is not in contact with the dome-shaped spring 2F in a state when the dome-shaped spring 2F is not pressed down. A surface of the substrate 3D except the stationary contacts 4D, 5D and 6D is designated as a surface 3Da. The surface 3Da is a flat surface.

The stationary contacts 4D, 5D and 6D are arranged such that top surfaces thereof are protruding from the surface 3Da. The surfaces of the stationary contacts 4D and 5D are designated as surfaces 4Da and 5Da. The surfaces 4Da and 5Da are inclined at an angle of δ (δ γ1) against the surface 3Da.

The switch 50 has the dome-shaped spring 2F and, as an exemplary embodiment, it becomes possible to reduce the sizes of the dome-shaped spring 2F and the switch 50 while a click action can be obtained with reliability. Furthermore, by virtue of the stationary contacts 4D and 5D, the angle of the circumferential edge of the dome-shaped spring 2F to the stationary contacts 4D and 5D is made near parallel and the contact between the circumferential edge and the stationary contacts 4D and 5D becomes near surface contact, and thus the displacement of the circumferential edge of the dome-shaped spring 2F to the radius vector can be reduced and wearing of the stationary contact 4D and 5D can be suppressed.

It is also possible to combine at least any two elements of the above exemplary embodiment, varieties and examples. For example, the dome-shaped spring 2C, 2D or 2E of a second variety may be substituted for the dome-shaped spring 2 of the switch 30 of a first example. Or for the switch 30 of a first example, the dome-shaped spring 2 may be fixed by the spring holding sheet 9 of a second example instead of the fixing portion 8*a*.

The dome-shaped springs of an exemplary embodiment, varieties and examples are assumed such that whole of the neutral plane is aspheric; however, the present invention is not limited to them. That is, at least a part of a moving portion, when buckled, of the dome-shaped spring may be aspheric. For example, a circular portion of the center of the dome-shaped spring is spherical and the other portion is aspheric.

Although a switch is explained as a device having the dome-shaped spring in an exemplary embodiment, varieties and examples, the present invention is not limited to a switch. The dome-shaped spring can be applied to another device such as a connector. For example, when the aspheric dome-shaped spring is applied to a connector, a contact of a connector is the aspheric dome-shaped spring so that a click action can be obtained by the dome-shaped spring when the connector is connected. In other words, the contact of the dome-shaped spring and a contact to be connected are electrically conducted via the dome-shaped spring at the same time of the click action generated by the buckling of the dome-shaped spring when the connector is connected. As a result, a user can feel a click feel, a connector can be downsized and wear of the dome-shaped spring and stationary contacts can be reduced.

It should be noted that a detailed structure, each element or each operation of the dome-shaped springs and switches of an exemplary embodiment, varieties and examples above explained can be modified within the gist of the present invention.

What is claimed is:

1. A dome-shaped spring adapted to be placed on a substrate having a first stationary contact, the dome-shaped spring comprising a circumferential edge which is continuously in contact with the first stationary contact when the dome-shaped spring is placed on the substrate, wherein:

at least a part of a neutral plane of the dome-shaped spring has a shape defined by an even function of at least eighth-order, and an angle $\alpha$ of the neutral plane to the substrate at a second inflection point existing at a second-positioned inflection point from the circumferential edge to a center of the spring, an angle $\beta$ of the neutral plane to the substrate at a first inflection point existing at a first-positioned inflection point from the circumferential edge to the center of the spring, and an angle $\gamma$ of the neutral plane to the substrate at the circumferential edge satisfy the following inequalities:

$\alpha \leq \beta$ and $\beta \geq \gamma$.

2. The dome-shaped spring according to claim 1, wherein a part of the dome-shaped spring is cut out.

3. A switch comprising:

the dome-shaped spring according to claim 1; and the substrate on which the dome-shaped spring is placed;

wherein the dome-shaped spring is provided with a movable contact at a center portion thereof, the substrate includes a first stationary contact and a second stationary contact that contact with the movable contact when the dome-shaped spring is buckled, the dome-shaped spring includes a conductor, and the first stationary contact and the second stationary contact are electrically conducted via the dome-shaped spring in a buckled state when the dome-shaped spring is pressed down.

4. A switch comprising:

the dome-shaped spring according to claim 2; and the substrate on which the dome-shaped spring is placed;

wherein the dome-shaped spring is provided with a movable contact at a center portion thereof, the substrate includes a first stationary contact and a second stationary contact that contact with the movable contact when the dome-shaped spring is buckled, the dome-shaped spring includes a conductor, and the first stationary contact and the second stationary contact are electrically conducted via the dome-shaped spring in a buckled state when the dome-shaped spring is pressed down.

5. The switch according to claim 3, further comprising one of a fixing portion and a spring holding sheet that holds the dome-shaped spring at a predetermined position on the substrate.

6. The switch according to claim 4, further comprising one of a fixing portion and a spring holding sheet that holds the dome-shaped spring at a predetermined position on the substrate.

7. The switch according to claim 3, further comprising an operating button for receiving a pressing force and transferring the force as an acting load to the dome-shaped spring.

8. The switch according to claim 4, further comprising an operating button for receiving a pressing force and transferring the force as an acting load to the dome-shaped spring.

9. The switch according to claim 5, further comprising an operating button for receiving a pressing force and transferring the force as an acting load to the dome-shaped spring.

10. The switch according to claim 6, further comprising an operating button for receiving a pressing force and transferring the force as an acting load to the dome-shaped spring.

* * * * *

UNITED STATES PATENT AND TRADEMARK OFFICE

CERTIFICATE OF CORRECTION

PATENT NO. : 8,957,339 B2
APPLICATION NO. : 13/467294
DATED : February 17, 2015
INVENTOR(S) : Chikara Sekiguchi et al.

It is certified that error appears in the above-identified patent and that said Letters Patent is hereby corrected as shown below:

In the Specification

Column 2, Line 40, delete "$\beta 1 \leq \gamma 1$" and insert --$\beta 1 < \gamma 1$--.

Column 3, Line 22, delete "$\alpha \leq \beta$ and $\beta \geq \gamma$" and insert --$\alpha < \beta$ and $\beta > \gamma$--.

Column 6, Line 19, delete "$\alpha \leq \beta$" and insert --$\alpha < \beta$--.

Column 6, Line 22, delete "$\beta \geq \gamma$" and insert --$\beta > \gamma$--.

In the Claims

Column 13, Line 24, Claim 1, Line 18, delete "$\alpha \leq \beta$ and $\beta \geq \gamma$" and insert --$\alpha < \beta$ and $\beta > \gamma$--.

Signed and Sealed this
Twenty-ninth Day of September, 2015

Michelle K. Lee

Michelle K. Lee
*Director of the United States Patent and Trademark Office*